US005376298A

United States Patent [19]

Michael

[11] Patent Number: 5,376,298

[45] Date of Patent: Dec. 27, 1994

[54] HARD SURFACE DETERGENT COMPOSITIONS

[75] Inventor: Daniel W. Michael, Cincinnati, Ohio

[73] Assignee: The Procter & Gamble Company, Cincinnati, Ohio

[21] Appl. No.: 99,115

[22] Filed: Jul. 29, 1993

[51] Int. Cl.[5] ..... C11D 1/12; C11D 1/66; C11D 1/722; C11D 17/00

[52] U.S. Cl. ..... 252/153; 252/121; 252/170; 252/171; 252/174.21; 252/174.19; 252/548; 252/DIG. 10

[58] Field of Search ..... 252/121, 153, 170, 171, 252/174.21, 174.19, 548, DIG. 10

[56] References Cited

U.S. PATENT DOCUMENTS

| | | | |
|---|---|---|---|
| 3,882,038 | 5/1975 | Clayton et al. | 252/164 |
| 4,533,485 | 8/1985 | O'Connor et al. | 252/156 |
| 4,827,028 | 5/1989 | Scardera et al. | 562/583 |
| 4,830,769 | 5/1989 | O'Lenick et al. | 252/49.3 |
| 4,994,153 | 2/1991 | Piano et al. | 204/15 |
| 5,030,245 | 7/1991 | Hemling et al. | 8/560 |
| 5,120,326 | 6/1992 | Hemling et al. | 8/598 |
| 5,202,050 | 4/1993 | Culshaw et al. | 252/170 |
| 5,290,472 | 3/1994 | Michael | 252/170 |

OTHER PUBLICATIONS

Olin Surfactants/Product Data—Poly-Tergent ® C-Series Polycarboxylated Multifunctional Surfactants (two pages) 1991.

Olin Application Data—Poly-Tergent ® CS-1 Sequestering Properties (three pages) 1989.

*Primary Examiner*—Glennon H. Hollrah
*Assistant Examiner*—Mary C. Cebulak
*Attorney, Agent, or Firm*—Robert B. Aylor

[57] ABSTRACT

Detergent compositions with excellent spotting/filming characteristics comprising nonionic detergent surfactant, preferably having a conventional hydrocarbon hydrophobic group and polyalkoxylate hydrophilic group; polyalkoxylate polycarboxylate surfactant-/builder containing hydrocarbon hydrophobic group, polyalkoxylate moiety, and polyanionic moieties that are carboxyl groups except for one optional sulfate or sulfonate group; optional hydrophobic cleaning solvent and/or polycarboxylate detergent builder; and optional suds control system preferably comprising fatty acid and anionic sulfonated and/or sulfated detergent surfactant. The compositions are preferably in the form of aqueous liquids and preferably have monoethanolamine and/or beta-aminoalkanol present.

24 Claims, No Drawings

HARD SURFACE DETERGENT COMPOSITIONS

FIELD OF THE INVENTION

This invention pertains to detergent compositions for hard surfaces. Such compositions typically contain detergent surfactants, detergent builders, and/or solvents to accomplish their cleaning tasks.

BACKGROUND OF THE INVENTION

The use of hard surface cleaning compositions containing organic water-soluble synthetic detergents, solvents, and, optionally, detergent builders are known. However, such compositions need improved cleaning while maintaining good spotting/filming.

An object of the present invention is to provide detergent compositions which provide excellent cleaning plus good spotting/filming.

SUMMARY OF THE INVENTION

This invention relates to hard surface detergent compositions with excellent spotting/filming characteristics comprising nonionic detergent surfactant, either conventional surfactant containing a hydrocarbon hydrophobic group and polyethoxylate hydrophilic group, or propylene glycol/ethylene glycol block copolymer nonionic detergent surfactant, preferably in a surfactant mixture with a nonionic detergent surfactant having a conventional hydrocarbon hydrophobic group and a mixed propylene glycol/ethylene glycol hydrophilic group; polyalkoxylate polycarboxylate surfactant-/builder containing a hydrophobic group, a polyalkoxylate moiety, and multiple carboxylate anionic groups, preferably of the type disclosed in U.S. Pats. Nos. 4,533,485; 4,827,028; and 5,120,326, said patents being incorporated herein by reference; optional, but preferred, hydrophobic cleaning solvent; and optional suds control system preferably comprising fatty acid and synthetic anionic, preferably sulfonated and/or sulfated, detergent surfactant.

The hard surface detergent composition, preferably aqueous, preferably comprises: (a) conventional nonionic detergent surfactant comprising a hydrocarbon hydrophobic group, preferably alkyl, and a polyethoxylate hydrophilic group to provide an HLB of from about 6 to about 18, preferably from about 8 to about 16; (b) alkyl polyalkoxylate polycarboxylate surfactant-/builder; (c) optional hydrophobic solvent that provides a primary cleaning function, when present, is preferably at a level of less than about 6%; (d) optional, but preferred, suds control system, which preferably comprises a low level of fatty acid and synthetic anionic detergent surfactant; and (e) optional polycarboxylate detergent builder which is not (b); and (f) the balance typically being an aqueous solvent system and minor ingredients, preferably color and/or perfume, said composition having a pH of from about 9 to about 12.5, preferably from about 9.5 to about 11.5, more preferably from about 10 to about 11. The composition can also contain, optionally, small amounts of additional surfactants and/or buffering system (to maintain the desired pH). The compositions can be formulated either as concentrates, or at usage concentrations and can be packaged in a container having means for creating a spray to make application to hard surfaces more convenient.

DETAILED DESCRIPTION OF THE INVENTION

(a) The Nonionic Detergent Surfactant

The preferred nonionic detergent surfactants herein are the conventional ones that typically have an HLB of from about 6 to about 18, preferably from about 8 to about 16, more preferably from about 10 to about 14. Typical of these are alkoxylated (especially ethoxylated) alcohols and alkyl phenols, and the like, which are well-known from the detergency art. In general, such nonionic detergent surfactants comprise a hydrophobic group which is a hydrocarbyl group, preferably derived from fatty alcohols, which contain an alkyl group in the $C_{6-22}$, preferably $C_{8-18}$, more preferably $C_{8-10}$, range and generally contain from about 2.5 to about 12, preferably from about 4 to about 10, more preferably from about 5 to about 8, ethylene oxide groups, to give an HLB of from about 8 to about 16, preferably from about 10 to about 14.

The total level of all nonionic detergent surfactant depends upon the type of product, but is typically from about 1% to about 20%, preferably from about 2 to about 15%, more preferably from about 5% to about 10%. Concentrated compositions contain from about 5% to about 30%, preferably from about 7% to about 25%.

Other nonionic detergent surfactants which are useful herein include block copolymers of propylene glycol and ethylene glycol having the formula:

$$R(EO)_n(PO)_m(EO)_nR$$

wherein EO is ethylene oxide, PO is propylene oxide, each n and m are selected to give a surfactant having a total molecular weight of from about 2,000 to about 8,000, preferably from about 3,000 to about 10,000, more preferably from about 4,000 to about 8,000, and each R being selected from hydrogen (preferred) and hydrocarbon groups, preferably $C_{1-4}$ hydrocarbon groups. These surfactants have an EO content of from about 20% to about 80%, preferably from about 20% to about 40%. Such surfactants typically have an HLB of from about 4 to about 30, preferably from about 7 to about 24, more preferably from about 7 to about 18. This nonionic detergent surfactant is very mild and provides good cleaning with exceptional spotting/filming characteristics.

The block copolymers which have a relatively high molecular weight hydrophobic group are preferred for solubilization of perfume and those with the low molecular weight hydrophobic groups are preferred for ease of biodegradability. In general, an EO content of from about 20% to about 40% is preferred for spotting/filming, especially for "full strength" use. However, for use of dilute solutions, the compounds with high molecular weight hydrophobic groups are acceptable with EO contents that are high, e.g., up to about 80%.

A preferred cosurfactant for use with the above block copolymer detergent surfactant has the formula:

$$R^1(EO)_n(PO)_mR$$

wherein $R^1$ is a hydrophobic moiety such as is derived from a fatty alcohol, fatty acid, fatty acid amide, etc., as is well known in the art, and n and m are integers selected to give a hydrophilic group, the EO and PO groups being present in any desired order in the chain, and EO, PO, and R having the meanings given hereinbefore. The HLB of this cosurfactant is from about 9 to about 14, preferably from about 11 to about 13. The amount of this cosurfactant present in the surfactant mixture is from 0% to about 50%, preferably from 0% to about 20%, more preferably from 0% to about 10%. This cosurfactant provides increased ability of the surfactant mixture to remove oily soils and to suspend perfumes, especially the desirable oily perfumes with less than about 1% solubility in water.

Specific examples of block copolymer nonionic detergent surfactants useful herein include products sold by BASF under the names of Pluronic® and Plurafac®, i.e., Pluronics: F98, F108, F127, L62, L64, L72, L122, P65, P75, P84, P103, P104, P105, and P123 (block copolymers), and Plurafacs: RA20, RA30, D25, and B25-5 (cosurfactants). L indicates liquid, P indicates paste, and F indicates a flake solid.

A detailed listing of nonionic surfactants in general is found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, al so incorporated herein by reference. Mixtures which comprise nonionic detergent surfactants having HLBs outside the stated ranges can be used so long as the mixture has an HLB within the stated range.

(b) The Polyalkoxylate Polycarboxylate Surfactant/Builder

The polyalkoxylate polycarboxylate surfactant/builder provides improved cleaning, especially on hard-to-remove soils when the product is diluted. In addition, the polycarboxylate surfactant/builder provides good cleaning when used full strength, even if there is no hydrophobic cleaning solvent present. These materials can be part of highly concentrated compositions, since they do not readily separate from the formula and they are surprisingly good for filming/streaking and product stability.

An empirical formula for these polyalkoxylate polycarboxylate surfactant/builders is:

$$R—O—[CH(x)—CH(y)—O]_n—R^1$$

wherein R is a hydrophobic group, preferably a substituted, or unsubstituted, hydrocarbon group typically containing from about 6 to about 16 carbon atoms, preferably from about 8 to about 14 carbon atoms, x and y are each independently selected from the group consisting of hydrogen, methyl, and succinic acid radicals, with the proviso that at least one x or y moiety per molecule is a succinic acid radical, wherein n is between 1 and 60, and wherein $R^1$ is hydrogen, substituted hydrocarbon, unsubstituted hydrocarbon, sulfuric, or sulfonic radical, with any acid groups being neutralized by compatible cationic groups, e.g., sodium, potassium, alkanolammonium, magnesium, etc.

The formula for some of the preferred polyalkoxylate polycarboxylate surfactant/builder compounds is:

$$R—O—(C_2H_4O)_x—[CH(L)CH(L-)]_y—[CH_2CH(CH_3)O)_zQ$$

wherein R is a hydrocarbon hydrophobic group, preferably alkyl, containing from about 6 to about 16, preferably from about 8 to about 14 carbon atoms; x is a number from 0 to about 60, preferably from about 4 to about 50, more preferably from about 6 to about 50; L is either a $C_{1-3}$ alkyl group or a group having the formula $—CH(COO^-)CH_2(COO^-)$, with at least one L group in each molecule being $—CH(COO^-)CH_2(COO^-)$; y is a number from about 1 to about 12, preferably from about 2 to about 10, more preferably from about 3 to about 8; z is a number from 0 to about 20, preferably from 0 to about 15, more preferably from 0 to about 10; and Q is selected from the group consisting of H and sulfonate groups, the compound being rendered electrically neutral by the presence of cationic groups, preferably selected from the group consisting of sodium, potassium, and substituted ammonium, e.g., monoethanolammonium, cations. Specific examples of such polyalkoxylate polycarboxylate surfactant/builders include the following: Poly-Tergent® C9-51B (CS-1) (x=12; y=8; and z=17); Poly-Tergent® C9-62P (x=4; y=3; and z=17); Poly-Tergent® C9-74P (x:10; y=3.5; and z=3.5); and Poly-Tergent® C9-92 (x=approximately 55; y=6.5; and z=0). In the above examples, the x and z values are believed to be approximately correct. The y value is based upon the number of succinic groups present and is believed to be more accurate. The R group in each of the above examples is believed to be a linear $C_9$ alkyl group and the Q group is believed to be H.

The polyalkoxy polycarboxylate surfactant/builder is normally present at a level of from about 1% to a about 20%, preferably from about 2% to about 10%, more preferably from about 2% to about 5%. In concentrated formulas, the level is typically from about 2% to about 10%.

(c) The Hydrophobic Solvent

In order to obtain improved cleaning, especially of lipid soils, one can incorporate a hydrophobic solvent that has cleaning activity. Preferably, however, the hydrophobic solvent, when present, is at a level of less than about 6%, preferably less than about 4%, and a level of at least about 0.5%, preferably at least about 1%. The solvents employed in the hard surface cleaning compositions herein are some of the well-known solvents commonly used in hard surface cleaners. Such solvents typically are liquid at room temperature and readily volatile. The level of hydrophobic solvent is typically from about 0.5% to about 6%, preferably from about 1% to about 4%, most preferably from about 2% to about 4%. The higher levels are used only when superior spotting/filming is not desired.

Selection of solvent is based partly on the need to improve grease-cutting properties, and partly by aesthetic considerations. The preferred solvents for use herein include glycol ethers having the formula $R^1O(R^2O)_mH$ wherein each $R^1$ is an alkyl group which contains from about 4 to about 8 carbon atoms, each $R^2$ is either ethylene or propylene, and m is a number from 1 to about 3, and the compound has a solubility in water of less than about 20%, preferably less than about 10%, and more preferably less than about 6%. The most preferred glycol ethers are selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

The butoxy-propanol solvent should have no more than about 20%, preferably no more than about 10%, more preferably no more than about 7%, of the secondary isomer in which the butoxy group is attached to the secondary atom of the propanol for improved odor.

Such solvents also comprise diols having from 6 to about 16 carbon atoms in their molecular structure, especially diols having a solubility in water of from about 0.1 to about 20 g/100 g of water at 20° C.

Other solvents such as benzyl alcohol, n-hexanol, and phthalic acid esters of $C_{1-4}$ alcohols can also be used.

Terpene solvents and pine oil, are usable, but are preferably present only in small amounts since they are difficult to solubilize.

(d) The Suds Control System

The presence of a suds control system herein is highly preferred despite the low sudsing characteristics of the nonionic detergent surfactants. The preferred suds control system comprises fatty acid and anionic synthetic detergent surfactant.

(1) The Fatty Acid

The primary suds controlling ingredient is fatty acid containing from about 8 to about 22, preferably from about 10 to about 18, more preferably from about 10 to about 16, carbon atoms. Especially preferred fatty acids are derived from, e.g., coconut oil, palm kernel oil, and animal tallow.

The level of such fatty acid is from about 0.01% to about 0.3%, preferably from about 0.02% to about 0.20%, more preferably from about 0.02% to about 0.15%, for normal concentrations of nonionic detergent surfactant as set forth hereinbefore. Less fatty acid is needed for lower HLB nonionic detergent surfactants and more is needed for higher HLB nonionic detergent surfactants. Preferably the level of fatty acid is kept below about 0.1% in order to maintain superior spotting/filming performance. The ratio of nonionic detergent surfactant to fatty acid typically ranges from about 10:1 to about 120:1, preferably from about 20:1 to about 80:1.

The fatty acid does not control the suds of the nonionic detergent surfactant if it is used alone. Surprisingly, the fatty acid requires the presence of a small amount of anionic synthetic detergent surfactant, preferably a sulfonated or sulfated synthetic detergent surfactant, more preferably a sulfonated detergent surfactant as set forth hereinafter.

(2) The Anionic Sulfated or Sulfonated Detergent Surfactant

Typical synthetic, e.g., anionic sulfated and/or sulfonated detergent surfactants are the alkyl- and alkylethoxylate- (polyethoxylate) sulfates, paraffin sulfonates, alkyl benzene sulfonates, olefin sulfonates, alpha-sulfonates of fatty acids and of fatty acid esters, and the like, which are well known from the detergency art. In general, such detergent surfactants contain an alkyl group in the $C_9$-$C_{22}$, preferably $C_{10}$-$C_{18}$, more preferably $C_{12}$-$C_{16}$, range. The anionic detergent surfactants can be used in the form of their sodium, potassium or alkanolammonium, e.g., triethanolammonium salts. $C_{12}$-$C_{18}$ paraffin-sulfonates and $C_0$-$C_{15}$ alkyl benzene sulfonates are especially preferred in the compositions of the present type. Although alkyl sulfates are not very efficient, alkyl ethoxylate sulfates are relatively efficient.

A detailed listing of suitable anionic detergent surfactants, of the above types, for the detergent compositions herein can be found in U.S. Pat. No. 4,557,853, Collins, issued Dec. 10, 1985, incorporated by reference hereinbefore. Commercial sources of such surfactants can be found in McCutcheon's EMULSIFIERS AND DETERGENTS, North American Edition, 1984, McCutcheon Division, MC Publishing Company, also incorporated hereinbefore by reference.

The anionic detergent cosurfactant component is typically present at a level of from about 0.1% to about 3.5%, more preferably from about 0.25% to about 1%. Anionic detergent surfactants are desirably present in limited amounts to promote rinsing of the surfaces. However, the level of synthetic anionic detergent surfactant should be less than about one half of the nonionic detergent surfactant.

It has been surprisingly found that the ratio of anionic surfactant to fatty acid is particularly critical in the control of sudsing. Preferably the ratio of anionic to fatty acid ranges from about 20:1 to about 3:1, more preferably the ratio lies between about 12:1 and about 4:1.

(e) Optional Monoethanolamine and/or Beta-aminoalkanol

Monoethanolamine and/or beta-aminoalkanol compounds serve primarily as solvents when the pH is above about 10, and especially above about 10.7. They also provide alkaline buffering capacity during use. Also, they do not hurt the spotting/filming properties of hard surface cleaning compositions. When perfumes that have a high percentage of terpenes are incorporated, the beta-alkanolamines are often preferred, whereas the monoethanolamine is usually preferred.

Monoethanolamine and/or beta-alkanolamine, when present, are used at a level of from about 0.05% to about 10%, preferably from about 0.2% to about 5%. For dilute compositions they are typically present at a level of from about 0.05% to about 2%, preferably from about 0.1% to about 1%, more preferably from about 0.2% to about 0.7%. For concentrated compositions they are typically present at a level of from about 0.5% to about 10%, preferably from about 1% to about 5%.

Preferred beta-aminoalkanols have a primary hydroxy group. Suitable beta-aminoalkanols have the formula:

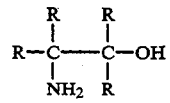

wherein each R is selected from the group consisting of hydrogen and alkyl groups containing from one to four carbon atoms and the total of carbon atoms in the compound is from three to six, preferably four. The amine group is preferably not attached to a primary carbon atom. More preferably the amine group is attached to a tertiary carbon atom to minimize the reactivity of the amine group. Specific preferred beta-aminoalkanols are 2-amino,1-butanol; 2-amino,2-methylpropanol; and mixtures thereof. The most preferred beta-aminoalkanol is 2-amino,2-methylpropanol since it has the lowest molecular weight of any beta-aminoalkanol which has the amine group attached to a tertiary carbon atom. The betaaminoalkanols preferably have boiling points below about 175° C. Preferably, the boiling point is within about 5° C. of 165° C.

Such beta-aminoalkanols are excellent materials for hard surface cleaning in general and, in the present application, have certain desirable characteristics.

Polar solvents with only minimal cleaning action like methanol, ethanol, isopropanol, ethylene glycol, propylene glycol, and mixtures thereof are usually not present in large quantities. When the nonaqueous solvent is present, the level of nonaqueous polar solvent is preferably from about 0.5% to about 5% and the level of water is from about 50% to about 97%, preferably from about 75% to about 95%.

(f) Aesthetic Ingredients

Aesthetic-enhancing ingredients such as colorants and perfumes are usually present. Preferably they do not adversely impact on spotting/filming in the cleaning of glass (i.e. those that are more water-soluble and/or volatile). However, many consumers prefer perfumes that are relatively water insoluble.

PERFUMES

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference.

Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

(g) Optional Ingredients

The compositions herein can also contain very low levels of other various adjuncts which are known to the art for detergent compositions so long as they are not used at levels that cause unacceptable spotting/filming. Nonlimiting examples of such adjuncts are:

- Very low levels of other detergent surfactants, e.g., zwitterionic detergent surfactants, and detergent builders;
- Enzymes such as proteases; and
- Hydrotropes such as sodium toluene sulfonate, sodium cumene sulfonate and potassium xylene sulfonate.

Zwitterionic Detergent Surfactants

Only low levels of zwitterionic detergent surfactants are present. Such surfactants contain both cationic and anionic hydrophilic groups on the same molecule at a relatively wide range of pH's. The typical cationic group is a quaternary ammonium group, although other positively charged groups like sulfonium and phosphonium groups can also be used. The typical anionic hydrophilic groups are carboxylates and sulfonates, although other groups like sulfates, phosphates, etc. can be used. A generic formula for some preferred zwitterionic detergent surfactants is:

$$R—N^{(+)}(R^2)(R^3)R^4X^{(-)}$$

wherein R is a hydrophobic group; $R^2$ and $R^3$ are each $C_{1-4}$ alkyl, hydroxy alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group containing from about one to about four carbon atoms; and X is the hydrophilic group which is preferably a carboxylate or sulfonate group.

Preferred hydrophobic groups R are alkyl groups containing from about 8 to about 22, preferably less than about 18, more preferably less than about 16, carbon atoms. The hydrophobic group can contain unsaturation and/or substituents and/or linking groups such as aryl groups, amido groups, ester groups, etc. In general, the simple alkyl groups are preferred for cost and stability reasons.

A specific "simple" zwitterionic detergent surfactant is 3-(N-dodecyl-N,N-dimethyl )-2-hydroxy-propane-1-sulfonate, available from the Sherex Company under the trade name "Varion HC".

Other specific zwitterionic detergent surfactants have the generic formula:

$$R—C(O)—N(R^2)—(CR^3{}_2)_n—N(R^2)_2{}^{(+)}—(CR^3{}_2)_n—SO_3{}^{(-)}$$

wherein each R is a hydrogen, e.g., an alkyl group containing from about 8 up to about 20, preferably up to about 18, more preferably up to about 16 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups. The $R^2$ groups can also be connected to form ring structures. A detergent surfactant of this type is a $C_{10}$-$C_{14}$fatty acylamidopropylene(hydroxypropylene)sulfobetaine that is available from the Sherex Company under the trade name "Varion CAS Sulfobetaine".

Other zwitterionic detergent surfactants useful herein include hydrocarbyl, e.g., fatty, amidoalkylenebetaines (hereinafter also referred to as "HAB"). These detergent surfactants have the generic formula:

$$R—C(O)—N(R^2)—(CR^3{}_2)—_n—N(R^2)_2{}^{(+)}—(CR^3{}_2)_n—C(O)O^{(-)}$$

wherein each R is a hydrocarbon, e.g., an alkyl group containing from about 8 up to about 20, preferably up to about 18, more preferably up to about 16 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3_2$) moiety. The R groups can be branched and/or unsaturated, and such structures can provide spotting/filming benefits, even when used as part of a mixture with straight chain alkyl R groups.

An example of such a detergent surfactant is a $C_{10-14}$ fatty acylamidopropylenebetaine available from the Miranol Company under the trade name "Mirataine BD".

The level of zwitterionic detergent surfactant in the composition is typically from 0% to about 0.5%, preferably from about 0.02% to about 0.5%, more preferably from about 0.05% to about 0.25%.

POLYCARBOXYLATE DETERGENT BUILDERS

Only low levels of polycarboxylate detergent builders can be present. One of the advantages of this invention is that the need for builders is less. However, it can still be advantageous to use a small amount of builder. Such builders include the builders disclosed in U.S. Pat. No. 4,915,854, Mao et. al., issued Apr. 10, 1990, and incorporated herein by reference. Suitable detergent builders preferably have relatively strong binding constants for calcium. Preferred detergent builders include citrates and, especially, builders whose acids have the generic formula:

$$R^5—[O—CH(COOH)CH(COOH)]_nR^5$$

wherein each $R^5$ is selected from the group consisting of H and OH and n is a number from about 2 to about 3 on the average. Other preferred detergent builders include those described in U.S. Pat. No. 5,051,573 of Stephen Culshaw and Eddy Vos for "Hard-Surface Cleaning Compositions," issued Sep. 24, 1991, said patent being incorporated herein by reference.

In addition to the above detergent builders, other detergent builders that are relatively efficient for hard surface cleaners and/or, preferably, have relatively reduced filming/streaking characteristics include those disclosed in U.S. Pat. No. 4,769,172, Siklosi, issued Sep. 6, 1988, and incorporated herein by reference.

The chelating agents of the invention, when they are present, are at levels of from about 0.5% to about 10% of the total composition, preferably about 1% to about 8%., more preferably from about 1% to about 6%.

The detergent builders can help provide the desired pH in use. However, if necessary, the composition can also contain additional buffering materials to give the desired pH in use. pH is usually measured on the product.

The compositions of this invention are preferably substantially free of materials that will adversely affect spotting/filming. Additionally, the compositions should not contain large amounts of materials that have no function. Examples of such materials include: degraded starch materials; sugar; solvents such as chloroform, short chain alcohols, glycols, etc.; sanitizers like quaternary ammonium and/or iodophor bacteriacides; etc.

These compositions have exceptionally good spotting/filming properties. They also have good "shine" properties, i.e., when used to clean glossy surfaces, without rinsing, they have much less tendency than e.g., phosphate built products to leave a dull finish on the surface.

The product can be packaged in a container that comprises a means for creating a spray, e.g., a pump, aerosol propellant and spray valve, etc.

All parts, percentages, and ratios herein are "by weight" unless otherwise stated. All numerical values are approximations unless otherwise stated.

The invention is illustrated by the following Examples.

EXAMPLES 1-5

| Ingredient | Example No.: 1 Wt. % | 2 Wt. % | 3 Wt. % | 4 Wt. % | 5 Wt. % |
|---|---|---|---|---|---|
| Poly-Tergent ® CS-1 | 5.0 | — | — | — | 3.5 |
| Poly-Tergent ® C9-92 | — | 5.0 | — | — | — |
| Poly-Tergent ® C9-74P | — | — | 5.0 | — | — |
| Poly-Tergent ® C13-82 | — | — | — | 5.0 | — |
| Alfonic ® 810-60 | 10.0 | 10.0 | 10.0 | 10.0 | 8.0 |
| Neodol ® 23-3 | 2.0 | 2.0 | 2.0 | 2.0 | |
| Secondary $C_{14-16}$ Alkane Sulfonate | 1.0 | 1.0 | 1.0 | 1.0 | 0.5 |
| Coconut Fatty Acid | 0.3 | 0.3 | 0.3 | 0.3 | 0.2 |
| Hydrophobic Perfume* | 1.0 | 1.0 | 1.0 | 1.0 | 0.3 |
| Monoethanolamine | 1.0 | 1.0 | 1.0 | 1.0 | 1.0 |
| Deionized Water and Minors | q.s. | q.s. | q.s. | q.s. | q.s. |

*Hydrophobic perfume consists mainly of terpenes, terpene alcohols, and other materials which are typically insoluble in water.
Poly-Tergent is a trade name of Olin Corp.; Alfonic is a trade name of Vista Chemical; and Neodol is a trade name of Shell Chemical Co.

EXAMPLES 6-7

| Ingredient | Example No.: 6 Wt. % | 7 Wt. % |
|---|---|---|
| Poly-Tergent ® C9-92 | 2.0 | 1.7 |
| Alfonic ® 810-60 | 20 | 17 |
| Secondary $C_{14-16}$ Alkane Sulfonate | — | 1.0 |
| Coconut Fatty Acid | 0.4 | 0.3 |
| Sodium Citrate | — | 4.0 |
| Monoethanolamine | 1.0 | 1.0 |
| Hydrophobic Perfume* | 1.3 | 1.3 |
| Deionized Water and Minors | q.s. | q.s. |
| pH | 11.0 | 10.2 |

*Hydrophobic perfume consists mainly of terpenes, terpene alcohols, and other materials which are typically insoluble in water.

What is claimed is:

1. A hard surface detergent composition with excellent spotting/filming characteristics comprising: film about 1% to about 30% of nonionic detergent surfactant; from about 1% to about 20% of polyalkoxylate polycarboxylate surfactant/builder compound comprising hydrocarbon hydrophobic group, polyalkoxylate moiety, and multiple anionic groups which comprise carboxylate groups, except for one optional sulfonate or sulfate group; optional hydrophobic cleaning solvent that provides a cleaning function at a level of from about 1% to about 6%, when present; optional suds control system; minor ingredient selected from the group consisting of color, perimite, and mixtures thereof, and, optionally, an aqueous solvent system, the pH of said composition being from about 9 to about 12.5.

2. The composition of claim 1 containing a suds control system comprising fatty acid and synthetic anionic detergent surfactant.

3. The composition of claim 2 wherein said anionic detergent surfactant is selected from the group consisting of paraffin sulfonates, alkyl benzene sulfonates, and alkyl ethoxylate sulfates.

4. The composition of claim 1 containing from about 1% to about 5% of said hydrophobic cleaning solvent, said solvent having a solubility in water of less than about 20%.

5. The composition of claim 4 wherein said hydrophobic cleaning solvent is selected from the group consisting of: benzyl alcohol, glycol ethers, and mixtures thereof.

6. The composition of claim 5 wherein said hydrophobic cleaning solvent has the formula $R^1O\ R^2O\ _mH$ wherein each $R^1$ is an alkyl group which contains from about 4 to about 8 carbon atoms, each $R^2$is selected from the group consisting of ethylene or propylene, and m is a number from 1 to about 3.

7. The composition of claim 6 wherein said hydrophobic cleaning solvent is selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

8. The composition of claim 1 additionally containing alkanolamine selected from the group consisting of monoethanolamine, beta-aminoalkanol, and mixtures thereof.

9. The composition of claim 8 wherein said alkanolamine comprises monoethanol amine.

10. The composition of claim 1 wherein said polyalkoxylate polycarboxylate surfactant/builder (b) has the empirical formula:

$$R—O—[CH(x)—CH(y)—O]_n—R^1$$

wherein R is a hydrophobic group which is either a substituted, or unsubstituted, hydrocarbon group containing from about 6 to about 16 carbon atoms; x and y are each independently selected from the group consisting of hydrogen, methyl, and succinic acid radicals, with the proviso that at least one x or y moiety per molecule is a succinic acid radical, wherein n is between 1 and 60, and wherein $R^1$ is hydrogen, substituted hydrocarbon, unsubstituted hydrocarbon, or sulfonic group, with any acid groups being neutralized by compatible cationic groups.

11. The composition of claim 1 wherein said polyalkoxylate polycarboxylate surfactant/builder has the formula:

$$R—O—(C_2H_4O)_x—[CH(L)CH(L)]_y—[CH_2CH(CH_3)O)_zQ$$

wherein R is a hydrocarbon hydrophobic group containing from about 6 to about 16 carbon atoms; x is a number from 0 to about 60; each L is either a $C_{1-3}$ alkyl group or a group having the formula $—CH(COO^-)CH_2(COO^-)$ with at least one group per molecule being $—CH(COO^-)CH_2(COO^-)$; y is a number from about 1 to about 12; z is a number from 0 to about 20; and Q is selected from the group consisting of H and sulfonate groups, the compound being rendered electrically neutral by the presence of cationic groups.

12. The composition of claim 10 wherein R is a hydrocarbon hydrophobic group containing from about 8 to about 14 carbon atoms; x is a number from about 4 to about 50; y is a number from about 2 to about 10; and z is a number from 0 to about 15.

13. The composition of claim 10 wherein Q is H.

14. The composition of claim 10 containing from about 1% to about 5% of said hydrophobic cleaning solvent, said solvent having a solubility in water of less than about 20%.

15. The composition of claim 10 wherein said hydrophobic cleaning solvent is selected from the group consisting of: benzyl alcohol, glycol ethers, and mixtures thereof.

16. The composition of claim 14 wherein said hydrophobic cleaning solvent has the formula $R^1O\ (R^2O\ _mH$ wherein each $R^1$ is an alkyl group which contains from about 4 to about 8 carbon atoms, each $R^2$is selected from the group consisting of ethylene or propylene, and m is a number from 1 to about 3.

17. The composition of claim 15 wherein said hydrophobic cleaning solvent is selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

18. The composition of claim 1 wherein the level of said nonionic detergent surfactant is from about 2% to about 10%; the level of said hydrophobic solvent is from about 1% to about 5%; there is a polycarboxylate detergent builder at a level of from about 1% to about 20%; and the pH of said composition is from about 9.5 to about 11.5.

19. The composition of claim 18 wherein the pH of said composition is from about 10 to about 11.

20. The composition of claim 19 wherein said hydrophobic cleaning solvent is selected from the group consisting of: benzyl alcohol, glycol ethers, and mixtures thereof.

21. The composition of claim 20 wherein said hydrophobic cleaning solvent has the formula $R^1O\ R^2O\ _mH$ wherein each $R^1$ is an alkyl group which contains from about 4 to about 8 carbon atoms, each $R^2$is selected from the group consisting of ethylene or propylene, and m is a number from 1 to about 3.

22. The composition of claim 21 additionally containing alkanolamine selected from the group consisting of monoethanolamine, beta-aminoalkanol, and mixtures thereof.

23. The composition of claim 22 wherein said alkanolamine comprises monoethanol amine.

24. The process of cleaning hard surfaces comprising applying the composition of claim 1 to said surfaces.

* * * * *